US005518178A

United States Patent [19]

Sahoo et al.

[11] Patent Number: 5,518,178

[45] Date of Patent: May 21, 1996

[54] THERMAL SPRAY NOZZLE METHOD FOR PRODUCING ROUGH THERMAL SPRAY COATINGS AND COATINGS PRODUCED

[75] Inventors: Purusottam Sahoo, Collegeville, Pa.; Anthony Mallilo, Palm Beach Gardens, Fla.

[73] Assignee: Sermatech International Inc., Limerick, Pa.

[21] Appl. No.: 204,534

[22] Filed: Mar. 2, 1994

[51] Int. Cl.[6] ..... C23C 4/12; B05B 7/22

[52] U.S. Cl. ..... 239/13; 239/79

[58] Field of Search ..... 239/79, 81, 13; 219/121.47, 121.48, 121.49, 121.5; 427/421, 422

[56] References Cited

U.S. PATENT DOCUMENTS

| | | |
|---|---|---|
| 2,770,708 | 11/1956 | Briggs . |
| 2,960,594 | 11/1960 | Thorpe . |
| 3,010,009 | 11/1961 | Ducati . |
| 3,075,065 | 1/1963 | Ducati et al. . |
| 3,140,421 | 7/1964 | Spongberg . |

(List continued on next page.)

FOREIGN PATENT DOCUMENTS

| | | |
|---|---|---|
| 473940 | 1/1937 | United Kingdom . |
| 876455 | 8/1961 | United Kingdom . |
| 915170 | 1/1963 | United Kingdom . |
| 943793 | 12/1963 | United Kingdom . |
| 958375 | 5/1964 | United Kingdom . |
| 967445 | 8/1964 | United Kingdom . |
| 972183 | 10/1964 | United Kingdom . |
| 990533 | 4/1965 | United Kingdom . |
| 1003118 | 9/1965 | United Kingdom . |
| 1012689 | 12/1965 | United Kingdom . |
| 1022556 | 3/1966 | United Kingdom . |
| 1125806 | 9/1968 | United Kingdom . |
| 1209672 | 10/1970 | United Kingdom . |
| 1382089 | 1/1975 | United Kingdom . |
| WO90/12123 | 10/1990 | WIPO . |

OTHER PUBLICATIONS

"Comparison of Major Thermal–Spray Coating Processes" Data Sheet, *Advanced Materials & Processes*, pp. 58 and 59, Feb. 1992.

N. N. Dorozhkin and V. V. Kuznetsov, "Plasma Spraying of Self–Fluxing Alloys Onto Heated Substrates" (Translated from *Poroshskovaya Metallurgiya*, No. 12 (144), pp. 51–56, Dec., 1974), pp. 993–996, 1975.

B. J. Gill, "Argon Shrouded Plasma Coatings for Gas Turbine Applications", *International Conference on PM Aerospace Materials* (Proceedings A89–33451 13–26), Lucerne, Switzerland, Nov. 2–4, 1987.

B. J. Gill and F. L. Ridding, "Argon Shrouded Plasma Spray Technology for Production Applications", *Surface Engineering*, vol. 2, No. 3, 1986.

(List continued on next page.)

*Primary Examiner*—Karen B. Merritt
*Attorney, Agent, or Firm*—Weiser & Associates

[57] ABSTRACT

Known thermal spray apparatus are modified to achieve rough thermal spray coatings. Thermal spray apparatus operate to develop a plasma stream for introduction to a nozzle, for eventual application to the surface of a substrate. Upon entering the nozzle, the plasma stream is passed through a plasma cooling zone defined by a plasma cooling passageway, to a plasma accelerating zone defined by a narrowed passageway that expands into a plasma/particle confining zone for the discharge of material from the apparatus. The narrowed passageway of the apparatus is cooled, and the powder material to be applied by the apparatus is introduced into the plasma stream along the cooled, narrowed passageway. For the appropriate heating (melting) and acceleration of MCrAlY powder particles, for application to the substrate which is to receive the thermal spray coating, the ratio of the cross-sectional area of the initial (plasma cooling) passageway relative to the cross-sectional area of the narrowed (plasma accelerating) passageway is reduced from the more conventional value of about 4:1 to a ratio of 2:1 or less.

43 Claims, 7 Drawing Sheets

U.S. PATENT DOCUMENTS

| | | | |
|---|---|---|---|
| 3,145,287 | 8/1964 | Siebein et al. . | |
| 3,179,783 | 4/1965 | Johnson . | |
| 3,179,784 | 4/1965 | Johnson . | |
| 3,301,995 | 1/1967 | Eschenbach et al. . | |
| 3,304,402 | 2/1967 | Thorpe . | |
| 3,470,347 | 9/1969 | Jackson . | |
| 3,533,756 | 10/1970 | Houseman . | |
| 3,573,090 | 3/1971 | Peterson . | |
| 3,591,759 | 7/1971 | Stand . | |
| 3,668,108 | 6/1972 | Houseman . | |
| 3,676,638 | 7/1972 | Stand . | |
| 3,684,911 | 8/1972 | Perugini et al. . | |
| 3,740,522 | 6/1973 | Muehlberger . | |
| 3,764,272 | 10/1973 | Sterling . | |
| 3,803,380 | 4/1974 | Ragaller . | |
| 3,806,698 | 4/1974 | Hare et al. . | |
| 3,814,620 | 6/1974 | Bailey et al. . | |
| 3,823,302 | 7/1974 | Muehlberger . | |
| 3,839,618 | 10/1974 | Muehlberger . | |
| 3,851,140 | 11/1974 | Coucher . | |
| 3,892,882 | 7/1975 | Guest et al. . | |
| 3,896,244 | 7/1975 | Ellis et al. . | |
| 3,914,573 | 10/1975 | Muehlberger . | |
| 4,127,760 | 11/1978 | Meyer et al. . | |
| 4,146,654 | 3/1979 | Guyonnet . | |
| 4,235,943 | 11/1980 | McComas et al. . | |
| 4,236,059 | 11/1980 | McComas et al. . | |
| 4,256,779 | 3/1981 | Sokol et al. . | |
| 4,741,286 | 5/1988 | Itoh et al. | 239/81 |
| 5,082,179 | 1/1992 | Simm et al. | 239/79 |

OTHER PUBLICATIONS

H. Herman, "Plasma–sprayed Coatings", *Scientific American*, Sep., 1988.

R. V. Hillery, B. H. Pilsner, R. L. McKnight, T. S. Cook and M. S. Hartle, "Thermal Barrier Coating Life Prediction Model Development—Final Report", *NASA Contractor Report 180807*, Nov., 1988.

"Hobart Tafa Acquires Advanced HVOF Technology", *Hobart Tafa Technologies*, Concord, New Hampshire, May, 1991.

"HVOF Turbine Engine Premium Coatings Guide—Metco 2600 Hybrid Performance", Metco–Perkin Elmer. Date Unknown.

G. Irons, "Higher Particle Velocities Produce Better Thermal Spray Coatings", *Hobart Tafa Technologies*, Concord, New Hampshire. Date Unknown.

G. Irons and V. Zanchuk, "Comparison of MCrAlY Coatings Sprayed by HVOF and Low Pressure Processes", *Proceedings of the 1993 National Thermal Spray Conference*, Anaheim, California, Jun. 7–11, 1993.

E. Kubel, Jr., "Thermal Spraying Technology: From Art to Science", *Advanced Materials & Processes Inc. Metal Progress*, Dec., 1987.

D. W. Parker and G. L. Kutner, "HVOF–Spray Technology", *Advanced Materials & Processes*, pp. 68–74, Apr., 1991.

S. C. Poulsen, "Le chalumeau Plasmadyne é arc plasma", *La Machine Moderne*, vol. 56, Apr., 1962 (with English language translation of sections).

T. N. Rhys–Jones, "Applications of Thermally Sprayed Coating Systems in Aero Engines", *U.S. Department of Commerce, National Technical Information Service*, 1989.

P. Sahoo and T. F. Lewis, "MCrAlY +X Coatings Applied Using the High Velocity Gator–Gard Plasma Spray System", *Thermal Spray: International Advances in Coatings Technology, Proceedings of the International Thermal Spray Conference*, Orlando, Florida, May 28–Jun. 5, 1992.

P. Sahoo and R. Raghuraman, "Gator–Gard® Applied Bond Coats for Thermal Barrier Coatings", *Proceedings of the 1993 National Thermal Spray Conference*, Anaheim, California, Jun. 7–11, 1993.

T. A. Taylor, M. P. Overs, B. J. Gill and R. C. Tucker, Jr., "Experience with MCrAl and Thermal Barrier Coatings Produced via Inert Gas Shrouded Plasma Deposition", *J. Vac. Sci. Technology*, A. vol. 3, No. 6, Nov./Dec. 1985.

M. L. Thorpe and H. J. Richter, "A Pragmatic Analysis and Comparison of HVOF Processes", *Hobart Tafa Technologies*, Concord, New Hampshire, pp. 1–27, 1992.

THERMAL SPRAY NOZZLE METHOD FOR PRODUCING ROUGH THERMAL SPRAY COATINGS AND COATINGS PRODUCED

BACKGROUND OF THE INVENTION

The present invention relates generally to the thermal spraying of powdered materials, as well as their application to surfaces as protective coatings.

A variety of thermal spray coatings have long been used to protect various components. A principal variety of thermal spray coatings to which the subject matter of the present invention pertains is the plasma spray process, This process has been used to apply many different types of coatings in numerous industries.

For the most demanding of service conditions (e.g., the high pressure turbine section of a modern gas turbine engine), protective coatings of the MCrAlY and thermal barrier type are often used. MCrAlY materials are generally comprised of a base metal M (including Ni, Co, Fe, and mixtures of these elements), Cr, Al and Y. Modifications of these coatings have included additions of other materials such as Si, Ta, Hf, and others, to enhance the resistance of such materials to high temperature oxidation and to improve mechanical properties.

Such coatings are conventionally applied either as a single layer (McrAlY) coating or as a dual layer coating (McrAlY layer and a ceramic layer). Protection of the surface of the component (i.e., the substrate) that receives such coatings is provided by various metallic constituents present in the coating. Adhesion of the coating to the surface of the component is accomplished by a thin interdiffusion layer that is formed after a post-coating heat treatment of the applied materials.

Another use for McrAlY coatings is as an essential part of a thermal barrier coating (TBC). Generally speaking, a thermal barrier coating is a multi-layer coating system that includes an insulating ceramic outer layer known as a "top coat", and a metallic inner layer known as a "bond coat". The bond coat is located between the top coat and the substrate which is to receive the thermal barrier coating. To a large extent, the durability of a thermal barrier coating depends upon the durability of the intermediate bond coat, since this layer serves to prevent separation of the thermal barrier coating from the substrate which receives it. The durability of the bond coat primarily depends upon three factors including the chemical composition of the bond coat, the process used to apply the bond coat to the substrate, and the surface finish of the substrate which is to receive the thermal barrier coating.

It has been found that McrAlY coatings used as overlay coatings are suitable as the bond coat for a thermal barrier coating. These McrAlY coatings can be applied to the substrate using a variety of thermal spray processes. Among the most popular of these are air plasma spraying (APS), argon-shrouded plasma spraying, vacuum plasma spraying and high velocity oxyfuel spraying (HVOF). In connection with the application of such materials to a substrate as a bond coat, more durable McrAlY coatings have been sought. Moreover, for use as a bond coat, a certain minimum roughness was found to be necessary for the ceramic top coat to mechanically adhere to the bond coat. Processes that would yield a coating with a minimum porosity and minimum amounts of oxides were also found to be desirable.

Although air plasma spraying is a relatively inexpensive process, the resulting coatings are characterized by significant amounts of porosity and oxides in the resulting (McrAlY) coating. Conversely, vacuum plasma spraying leads to high quality coatings, but at a very high cost. Argon-shrouded plasma spraying has also been found to produce an effective coating, but requires an injection of a secondary gas at a very high flow rate. High velocity oxyfuel spraying cannot easily provide sufficient heating of the powdered materials to achieve an acceptable coating. As a result, high quality coatings at a relatively inexpensive cost have generally not been attainable.

Similarly, for use as a bond coat in a two layer plasma sprayed thermal barrier coating, both roughness and purity are critical to achieving a satisfactory useful life. To this end, the generally accepted method for achieving a high quality bond coat is to spray the desired powder in a vacuum chamber. Again, this leads to certain disadvantages in actual implementation.

SUMMARY OF THE INVENTION

It is therefore the primary object of the present invention to provide improved rough thermal spray coatings for application to substrates.

It is also an object of the present invention to provide improved rough thermal spray coatings that employ McrAlY-type materials.

It is also an object of the present invention to provide improved rough thermal spray coatings for application to substrates in single layer applications, as well as multi-layer applications (including overlay and bond coat applications such as thermal barrier coatings).

It is also an object of the present invention to provide improved rough thermal spray coatings for application to substrates which can achieve highly dense and rough coatings at a reasonable cost.

It is also an object of the present invention to provide improved rough thermal spray coatings for application to substrates making use of a straightforward thermal spray apparatus of simplified construction.

It is also an object of the present invention to provide an apparatus for applying rough thermal spray coatings to substrates.

It is also an object of the present invention to provide substrates with improved rough thermal spray coatings.

These and other objects which will be apparent are achieved in accordance with the present invention by modifying known thermal spray apparatus to achieve the rough thermal spray coatings that are desired. For example, U.S. Pat. Nos. 4,256,779 and 4,235,943 disclose a plasma spray method and apparatus which is known in the industry as the "Gator-Gard®" System, offered by Sermatech International, Inc. of Limerick, Pa. Generally speaking, the disclosed apparatus is designed to utilize a plasma jet to improve the characteristics of a thermally sprayed coating. Upon entering the nozzle of the apparatus, the plasma stream is passed through a plasma cooling zone defined by a plasma cooling passageway, to a plasma accelerating zone defined by a narrowed passageway that expands into a plasma/particle confining zone for the discharge of material from the apparatus. The narrowed passageway of the apparatus is cooled, and the powder material to be applied by the apparatus is introduced into the plasma stream along the cooled, narrowed passageway. This results in appropriate heating (melting) and acceleration of the powder particles, for application to the substrate which is to receive the thermal spray coating.

Such apparatus has worked well for applying coatings of various types to appropriate substrates. A variety of wear resistant coatings such as WC-Co and CrC-NiCr have been effectively applied with such an apparatus. However, for purposes of applying MCrAlY coatings, such an apparatus was found to present certain disadvantages. For example, it is generally known that the use of coarser powders (if possible) will lead to the production of rougher coatings. However, it was found that in use, these coarser powders were not sufficiently melted to adhere to the substrate. Even when using finer powders, the flame jet produced by the apparatus could at times fluctuate unacceptably. What is more, the deposition rate of the resulting coating was at times found to be relatively low.

In accordance with the present invention, these problems are effectively overcome by suitably reducing the ratio of the initial (plasma cooling) passageway relative to the narrowed (plasma accelerating) passageway which follows. Effective results have been achieved by reducing this ratio from the more conventional value of about 4:1 to a ratio of 2:1 or less. This is achievable by enlarging (reaming) the narrowed passageway of the nozzle until the desired ratio is obtained.

Resulting from this, it has been found that McrAlY powders of various types and having a wide range in size could now be effectively applied by a plasma spray method and apparatus. The disadvantages of fluctuation in the flame jet and relatively low deposition rates were also significantly improved upon. This is so even though it had previously been believed that enlargement of the narrowed passageway of the nozzle would lead to unacceptable results. Indeed, for wear resistant coatings such as WC-Co and CrC-NiCr, such a nozzle configuration would have been virtually inoperative. The reason for this is that for such applications, both the velocity (momentum) and enthalpy (heat transfer) are crucial toward obtaining a high quality coating, which suggested against enlargement of the narrowed passageway of the nozzle. However, it has been found that for McrAlY-type coatings, enthalpy transfer is more important than momentum transfer. Consequently, an enlargement of the passageway is not only possible, but indeed leads to improved results.

For further detail regarding such improvements, reference is made to the detailed description which is provided below, taken in conjunction with the following illustrations.

DETAILED DESCRIPTION OF PREFERRED EMBODIMENTS

Figure 1A:
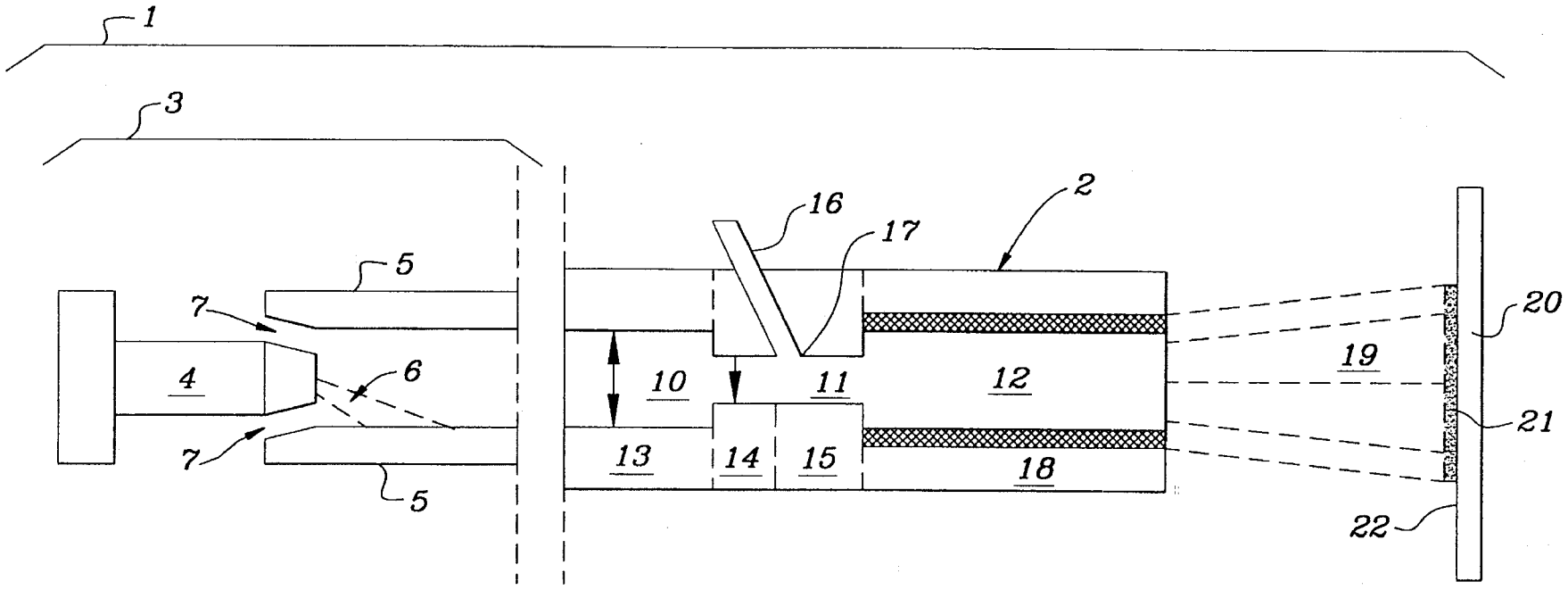
FIG. 1*a* is a schematic illustration of a plasma spray apparatus for implementing the improvements of the present invention.
Figure 1B:
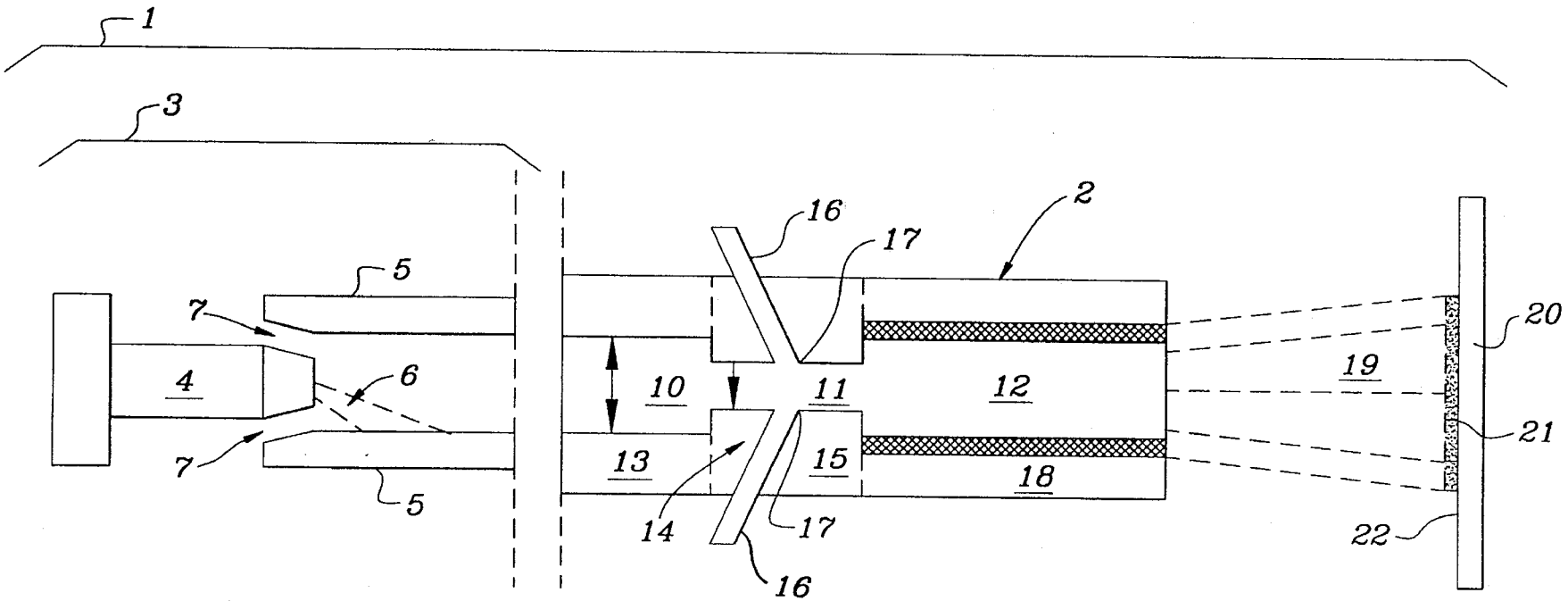
FIG. 1*b* is a schematic illustration of a similar plasma spray apparatus, including plural particle introducing conduits.

FIG. 1*a* (as well as FIG. 1*b*) is a schematic representation of a thermal spray apparatus 1 corresponding to the thermal spray apparatus disclosed in U.S. Pat. No. 4,256,779 and incorporating the improvements of the present invention. The thermal spray apparatus 1 is generally comprised of a nozzle assembly 2 (i.e., an insert) which is mated to a plasma gun 3. The plasma gun 3 employs a cooperating cathode 4 (preferably formed of tungsten) and anode 5 (preferably formed of copper). The cathode 4 and anode 5 are electrically excited to produce an arc, at 6, for igniting a plasma-forming gas (e.g., an inert gas such as helium) which is introduced at 7, between the cathode 4 and the anode 5. The plasma gun 3 is mated with the nozzle assembly 2 so that the resulting plasma stream is introduced into an inlet passageway 10 of the nozzle assembly 2. The inlet passageway 10 communicates with a narrowed passageway 11, which thereafter expands outwardly into a ceramic nozzle 12.

In operation, the plasma stream produced by the plasma gun 3 enters the inlet passageway 10. The inlet passageway 10 is surrounded by a cooling medium, such as water, to define a plasma cooling zone 13. In passing from the inlet passageway 10 to the narrowed passageway 11, the plasma stream is constricted along a plasma acceleration zone 14. Thereafter, the plasma stream passes through a particle introduction zone 15 which incorporates one (FIG. 1*a*) or more (FIG. 1*b*) conduits 16 for receiving a powder to be introduced into the plasma stream through one or more ports 17. Upon entering the particle introduction zone 15, powder introduced through the port 17 enters the narrowed passageway 11, where it is heated to a plasticized state and accelerated in a ceramic nozzle 12. The plasticized and accelerated powder particles are then discharged from this plasma/particle confining zone 18, exiting the nozzle assembly 2 as a spray 19 for application to an appropriate substrate 20. The result is a thermal spray coating 21 applied to the surface 22 of the substrate 20.

In accordance with the present invention, it has been found that the characteristics of the thermal spray coating 21 can be varied by varying the dimensions and the shape of the passageways 10, 11, 12, as well as the powder introducing configuration defined by the conduits 16 and their corresponding ports 17. However, in accordance with the present invention it has been found that rough coatings can be applied to the surface of a substrate at an appropriate deposition rate by maintaining the ratio of the inlet passageway 10 relative to the narrowed passageway 11 to 2:1 or less. This is advantageously accomplished by enlarging (reaming) the narrowed passageway 11 to achieve the ratio which is desired for a particular application. This ratio will necessarily vary from application to application, depending upon numerous variables including the gas used to operate the plasma gun 3, the powder introduced by the conduit 16, and the characteristics desired for the coating 21 which is to be applied to the surface 22 of the substrate 20.

As an example, the narrowed passageway 11 of a conventional "Gator-Gard®" nozzle insert (the nozzle assembly 2) typically has an internal diameter of 0.152 inches. The inlet passageway 10 typically has an internal diameter of 0.287 inches. This leads to a ratio (in terms of their cross-sectional area) of the first passageway 10 relative to the narrowed passageway 11 of about 3.6:1. In accordance with the present invention, the narrowed passageway 11 is expanded from its nominal internal diameter of 0.152 inches to an enlarged diameter of 0.220 inches. This results in a ratio (cross-sectional area) of the first passageway 10 relative to the narrowed passageway 11 of about 1.7:1. Such enlargement has been found to provide rough thermal spray coatings of McrAlY-type powders which are highly dense, and which are applicable at commercially viable deposition rates.

As previously indicated, while it is known that coarser powders will yield rougher coatings, not all spray systems are amenable to the spraying of coarser powders. There are a variety of reasons for this. Coarse powders must be sufficiently molten to strongly adhere either to a substrate, or to a previously applied coating. Consequently, while coarse powders can be introduced into virtually any spray apparatus, the resulting quality of the applied coating will depend upon how well such powders are heated by the spray apparatus. It is for this very reason that high velocity oxyfuel spray systems presently cannot satisfactorily spray coarse powders. However, even known thermal spray systems, spraying coarse powders through a standard nozzle insert (as previously described), tend not to yield a coating of appropriate quality for reasons which follow.

Figure 2:
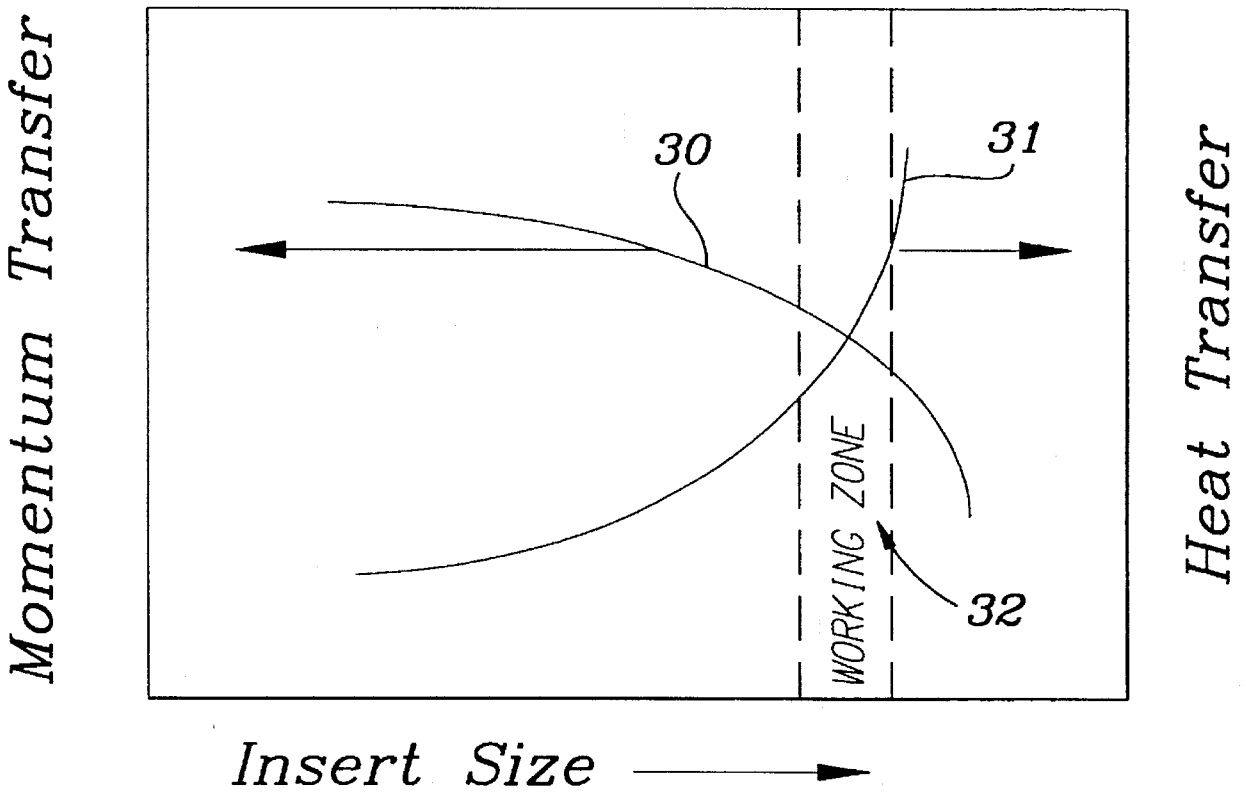
FIG. 2 is a graph showing theoretical variations in momentum and heat transfer responsive to variations in the diameter of the nozzle insert.

The internal diameters specified for the nozzle insert of the spray apparatus will effect both the momentum of the powder particles introduced into the nozzle, as well as heat transfer to the powder particles. A generalized description of this is provided with reference to FIG. 2. Illustrated are the effect of variations in the internal diameter of the nozzle insert upon the velocity 30 (momentum transfer) and enthalpy 31 (heat transfer) of the powder particles as they are introduced into the narrowed passageway 11. Not wishing to be bound by the following, since the actual polynomials describing these effects are not very well known, an increase in the internal diameter of the nozzle insert generally leads to lower velocities and higher heat transfers for a given powder. This defines a zone 32 where the velocity and heat transfer combine sufficiently to yield an acceptable coating. This zone 32 would include nozzle inserts with usable internal diameters for a given powder type, and would necessarily vary for different powder types.

Figure 3:
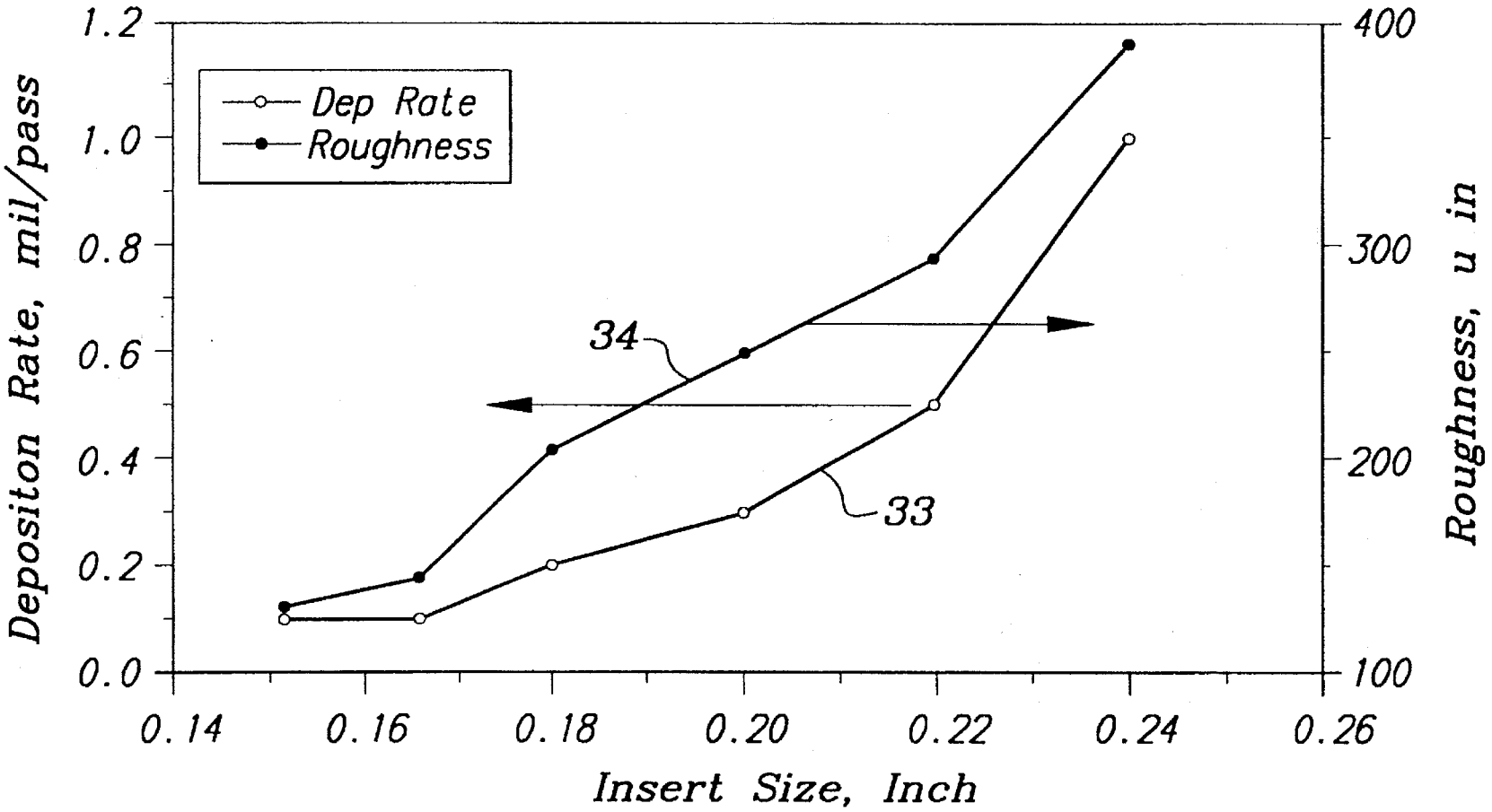
FIG. 3 is a graph showing variations in deposition rate and surface roughness responsive to variations in the diameter of the nozzle insert.
Figure 4:
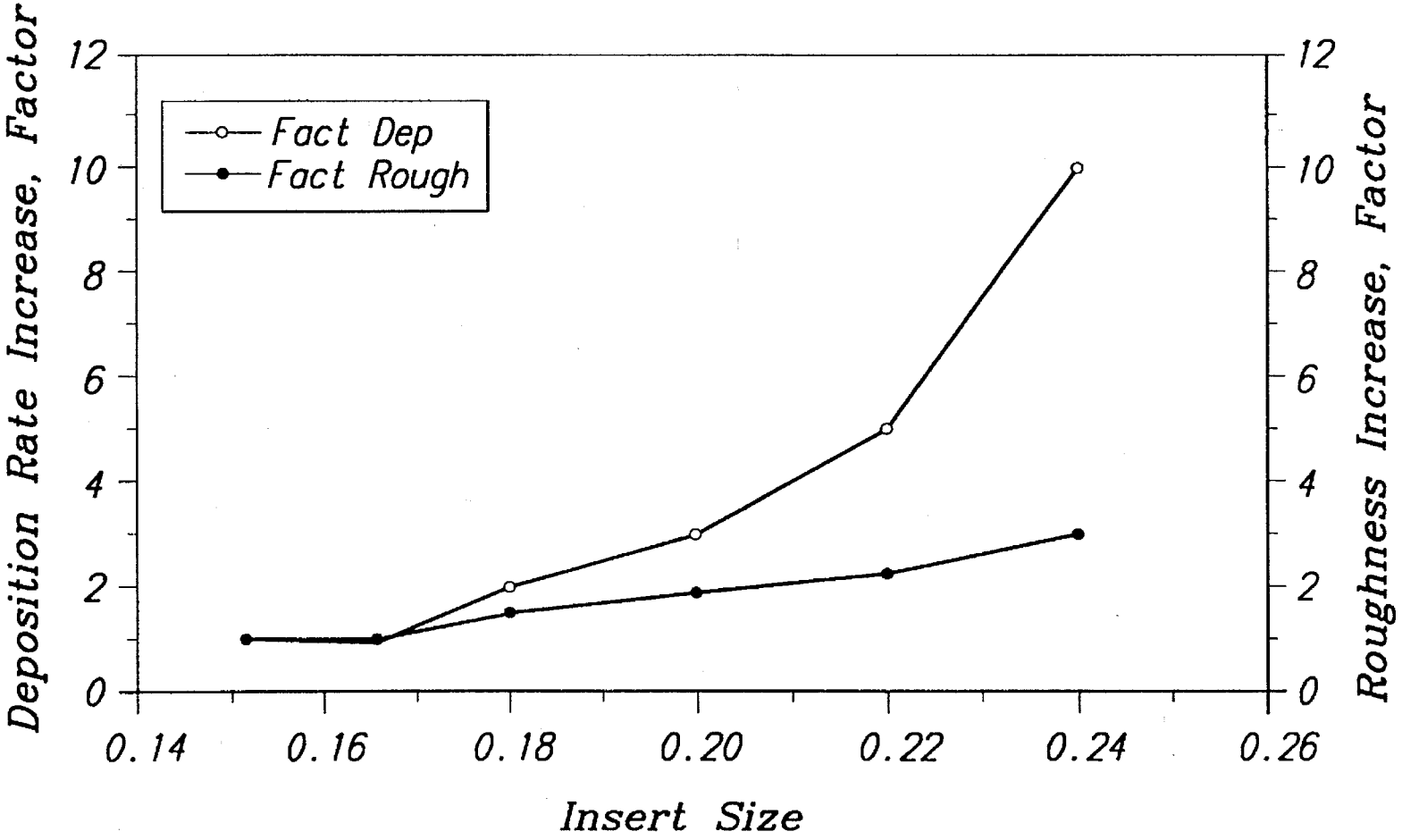
FIG. 4 is a graph showing variations in deposition rate and surface roughness responsive to variations in the nozzle insert, expressed as a factor of gain.

FIG. 3 shows the effect of variations in the diameter of the nozzle insert (the narrowed passageway 11) upon the deposition rate 33 and surface roughness 34 which are achievable for a specific McrAlY powder, in this case a NiCoCrAlY. This graph shows that with an increase in the diameter of the narrowed passageway 11, corresponding increases result in both the deposition rate 33 and the surface roughness 34 which are achieved. Because the graph of FIG. 3 depicts absolute values of the dependent variables, this graph does not reflect the true impact of expansion of the diameter of the narrowed passageway 11 on these dependent variables. To better demonstrate this, FIG. 4 is a graph which, for the same data points, shows the effect of variations in the diameter of the nozzle insert (the narrowed passageway 11) upon the deposition rate 35 and surface roughness 36, expressed as a factor of gain relative to corresponding data points obtainable for the standard (0.152 inch) diameter for the narrowed passageway 11. From this it is seen that, unexpectedly, the deposition rate 35 increases much faster than does the surface roughness 36. It is further seen that the steepest increase in deposition rate occurs for nozzle inserts having diameters above 0.20 inches. It is important to note that in assembling the data for the graphs of FIGS. 3 and 4, all other parameters (processing parameters) were kept identical.

Figure 5A:
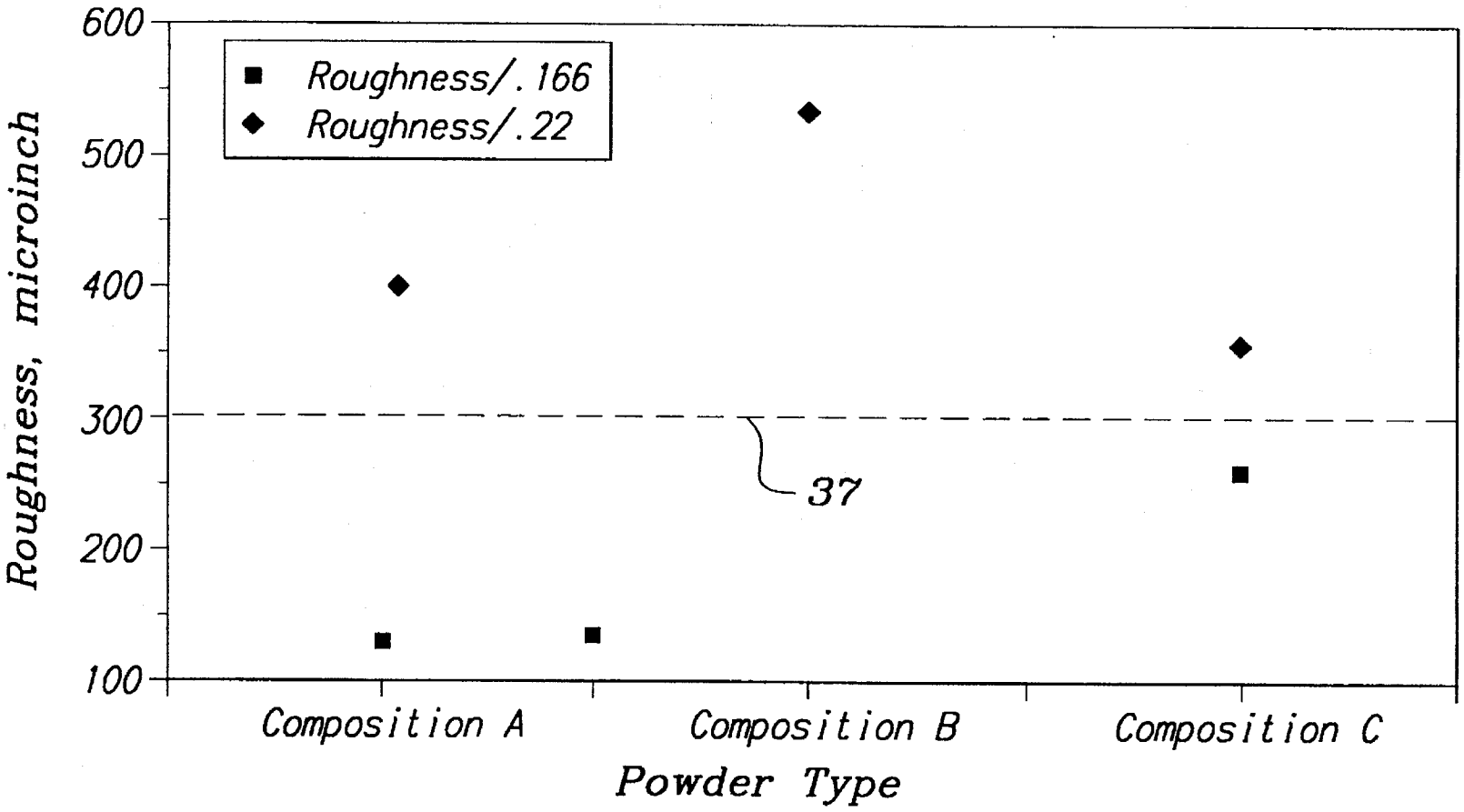
FIGS. 5A and 5B are graphs showing variations in surface roughness and deposition rate for different powder types, and for different nozzle insert diameters.
Figure 5B:
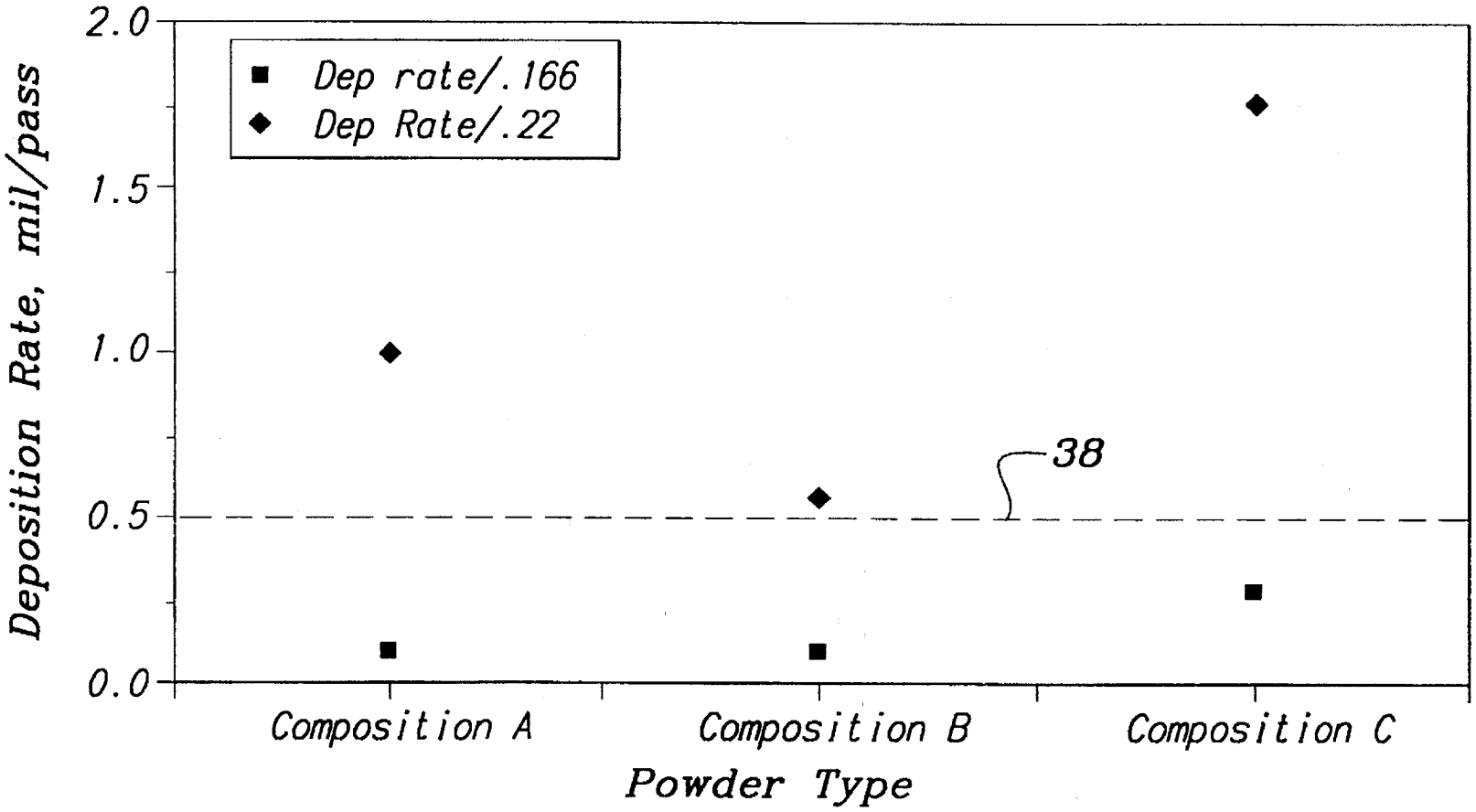

FIGS. 5A and 5B are graphs showing how various different types of powders interact with the thermal spray apparatus 1 of the present invention to apply coatings to a substrate. To this end, a comparison is made for three different types of powders, introduced into a nozzle assembly 2 having a narrowed passageway 11 with a diameter of 0.220 inches and 0.166 inches, respectively. The three powders represented in these graphs include a Composition A comprised of NiCoCrAlY, Hf and Si, a Composition B comprised of NiCoCrAlY, Ta, Re, Si and Hf and a Composition C comprised of CoNiCrAlY. In each case, resulting surface roughness and deposition rates were compared. Typical minimum requirements for surface roughness (300 microinches) and deposition rate (0.5 mil/pass) are identified by dashed lines 37, 38, respectively. From these graphs it is apparent that none of the identified powders are suitably used at the standard diameter of 0.166 inches, either in terms of their surface roughness or their deposition rate, while all of the powders are quite suitably used at the expanded diameter of 0.220 inches.

Consequently, the nozzle assembly 2 of the present invention is seen to provide coatings of suitable roughness and deposition rate, employing any of a number of available powders and under varying conditions. This can include different McrAlY powders, as well as powders based on nickel, cobalt or iron alloys having similar particle size (particle size distribution) and similar melting points. For example, for appropriate results, typical McrAlY powders should vary in size from about 5 μm to about 44 μm (i.e., 325 mesh). A range of from 8 μm to 30 μm is generally considered typical. Smaller particles tend to oxidize and vaporize. Larger particles tend not to melt sufficiently. Such particles should preferably exhibit a relatively tight particle size distribution (e.g., 10% by weight of particles less than 5 μm, 50% by weight of particles less than 15 μm, and 90% by weight of particles less than 35 μm). Since the two parameters of greatest importance to achieving a proper result are particle size distribution and melting point, it is expected that mixtures of any of a variety of equivalent powders are possible.

Such coatings are useful as single layer coatings, multilayer coatings, or as the bond coat for thermal barrier coatings. The nozzle assembly 2 has further been found to be useful for applying coatings of "low melting point" ceramics (e.g., $SiO_2$) and refractory elements to appropriate substrates (with or without a bond coat), and for spraying composite coatings (by providing multiple powder entry ports 17 as previously described), if desired.

It will be understood that various parameters associated with the nozzle assembly 2 are freely capable of variation to achieve desired spray conditions. This would include variations in the diameter and length of the passageways 10, 11, 12, as well as variations in the amount and type of powder which is used, the location of the ports 17 and the entry angle for the conduit 16. All of these variations have a potential effect upon the surface roughness and deposition rates that are achieved. If desired, variations in these parameters can also be used to product smoother coatings. Similar techniques can be employed with other types of coating systems, such as HVOF systems, apart from the thermal spray apparatus 1 described above.

It will therefore be understood that various changes in the details, materials and arrangement of parts which have been herein described and illustrated in order to explain the nature of this invention may be made by those skilled in the art within the principal and scope of the invention as expressed in the following claims.

What is claimed is:

1. A thermal spray apparatus for applying rough coatings to substrates, comprising:

means for producing a heated jet stream, and a nozzle assembly mated with the heated jet stream producing means;

wherein the nozzle assembly includes a first passageway having a first cross-sectional area in communication with the heated jet stream of the producing means, for receiving the heated jet stream therein, and a second passageway having a second cross-sectional area in communication with the first passageway, and wherein the cross-sectional area of the first passageway is proportioned relative to the cross-sectional area of the second passageway in a ratio of 2:1 or less.

2. The apparatus of claim 1 wherein the thermal spray apparatus includes plasma spray means associated therewith.

3. The apparatus of claim 1 wherein the producing means and the nozzle assembly combine to apply a coating having a roughness of at least 300 microinches.

4. The apparatus of claim 1 wherein the nozzle assembly further includes coolings means surrounding the first passageway.

5. The apparatus of claim 4 wherein the nozzle assembly further includes stream acceleration means defined by the second passageway, which is narrowed relative to the first passageway.

6. The apparatus of claim 1 wherein the second passageway has a diameter of at least 0.20 inches.

7. The apparatus of claim 6 wherein the ratio is a ratio of the cross-sectional area of the first passageway relative to the cross-sectional area of the second passageway.

8. The apparatus of claim 7 wherein the first passageway has a diameter of about 0.287 inches.

9. A thermal spray apparatus for applying rough coatings to substrates, comprising:

means for producing a heated jet stream, and a nozzle assembly mated with the heated jet stream producing means;

wherein the nozzle assembly includes a first passageway having a first cross-sectional area in communication with the heated jet stream of the producing means, for receiving the heated jet stream therein, a second passageway having a second cross-sectional area in communication with the first passageway, wherein the cross-sectional area of the first passageway is proportioned relative to the cross-sectional area of the second passageway in a ratio of 2:1 or less, cooling means surrounding the first passageway, stream acceleration means defined by the second passageway, which is narrowed relative to the first passageway, and means for introducing particles of a material into the second passageway, for forming the rough coatings.

10. The apparatus of claim 9 wherein the particles are formed of an McrAlY material.

11. The apparatus of claim 9 wherein the particle introducing means follows the stream acceleration means.

12. The apparatus of claim 11 which further includes a nozzle in communication with the second passageway, for discharging the particles of material from the nozzle assembly.

13. The apparatus of claim 9 wherein the particle introducing means is a conduit for receiving the particles and having a port for communicating with the second passageway.

14. The apparatus of claim 13 which further includes a plurality of conduits having a plurality of ports in communication with the second passageway.

15. A nozzle assembly for a thermal spray apparatus capable of applying rough coatings to substrates, comprising a first passageway having a first cross-sectional area, for receiving a heated jet stream therein, and a second passageway having a second cross-sectional area in communication with the first passageway, wherein the cross-sectional area of the first passageway is proportioned relative to the cross-sectional area of the second passageway in a ratio of 2:1 or less.

16. The apparatus of claim 15 wherein the nozzle assembly further includes cooling means surrounding the first passageway.

17. The apparatus of claim 16 wherein the nozzle assembly further includes stream acceleration means defined by the second passageway, which is narrowed relative to the first passageway.

18. The apparatus of claim 15 wherein the second passageway has a diameter of at least 0.20 inches.

19. The apparatus of claim 18 wherein the ratio is a ratio of the cross-sectional area of the first passageway relative to the cross-sectional area of the second passageway.

20. The apparatus of claim 19 wherein the first passageway has a diameter of about 0.287 inches.

21. A nozzle assembly for a thermal spray apparatus capable of applying rough coatings to substrates, comprising a first passageway having a first cross-sectional area, for receiving a heated jet stream therein, a second passageway having a second cross-sectional area in communication with the first passageway, wherein the cross-sectional area of the first passageway is proportioned relative to the cross-sectional area of the second passageway in a ratio of 2:1 or less, cooling means surrounding the first passageway, stream acceleration means defined by the second passageway, which is narrowed relative to the first passageway, and means for introducing particles of a material into the second passageway, for forming the rough coatings.

22. The apparatus of claim 21 wherein the particles are formed of an McrAlY material.

23. The apparatus of claim 21 wherein the particle introducing means follows the stream acceleration means.

24. The apparatus of claim 23 which further includes a nozzle in communication with the second passageway, for discharging the particles of material from the nozzle assembly.

25. The apparatus of claim 21 wherein the particle introducing means is a conduit for receiving the particles and having a port for communicating with the second passageway.

26. The apparatus of claim 25 which further includes a plurality of conduits having a plurality of ports in communication with the second passageway.

27. A method for thermal spray application of rough coatings to substrates, comprising the steps of:

introducing a heated jet stream into a nozzle assembly having a first passageway having a first cross-sectional area, for receiving the heated jet stream therein, and a second passageway having a second cross-sectional area in communication with the first passageway, wherein the cross-sectional area of the first passageway is proportioned relative to the cross-sectional area of the second passageway in a ratio of 2:1 or less;

accelerating the heated jet stream as it passes from the first passageway to the second passageway;

introducing particles of material for producing the rough coatings into the second passageway; and spraying the heated jet stream containing the particles of material toward the substrate, depositing a rough coating of the particles of material on the substrate.

28. The method of claim 27 wherein the heated jet stream is a plasma stream.

29. The method of claim 27 wherein the coating is applied to the substrate at a deposition rate of at least 0.5 mil/pass.

30. The method of claim 27 wherein the particles are formed of an McrAlY material.

31. The method of claim 27 wherein the particles are formed of a ceramic material.

32. The method of claim 31 wherein the ceramic material is applied directly to a surface of the substrate.

33. The method of claim 32 wherein the particles of material are introduced into the second passageway, following the accelerating step.

34. The method of claim 31 which further includes the step of applying a bond coating to the substrate, and wherein the ceramic material is applied to the bond coating.

35. The method of claim 34 wherein the bond coating is formed of an McrAlY material.

36. The method of claim 34 wherein the particles of material are introduced into the second passageway through a plurality of conduits having a plurality of ports in communication with the second passageway.

37. The method of claim 27 which further includes the step of cooling the heated jet stream within the first passageway.

38. The method of claim 37 which further includes the step of accelerating the heated jet stream within the second passageway, which is narrowed relative to the first passageway.

39. The method of claim 27 wherein the particles of material vary in size from about 5 μm to about 44 μm.

40. The method of claim 39 wherein the particles of material vary in size from about 8 μm to about 30 μm.

41. The method of claim 39 wherein the particles of material have a particle size distribution of about 10% by weight of particles having a size less than 5 μm, about 50% by weight of particles having a size less than 15 μm, and about 90% by weight of particles having a size less than 35 μm.

42. A plasma spray apparatus for applying rough coatings to substrates, comprising:

means for producing a plasma stream, and a nozzle assembly mated with the plasma stream producing means;

wherein the nozzle assembly includes a first passageway having a first cross-sectional area for communicating with the plasma stream producing means, for receiving the plasma stream therein, and a second passageway having a second cross-sectional area in communication with the first passageway, and wherein the cross-sectional area of the first passageway is proportioned relative to the cross-sectional area of the second passageway in a ratio of 2:1 or less.

43. A nozzle assembly for a plasma spray apparatus capable of applying rough coatings to substrates, comprising a first passageway having a first cross-sectional area, for receiving a plasma stream therein, and a second passageway having a second cross-sectional area in communication with the first passageway, wherein the cross-sectional area of the first passageway is proportioned relative to the cross-sectional area of the second passageway in a ratio of 2:1 or less.

* * * * *